US007056270B2

(12) United States Patent
Mellott

(10) Patent No.: US 7,056,270 B2
(45) Date of Patent: Jun. 6, 2006

(54) SANDWICH WALL CONSTRUCTION FOR A KIT BOX OR EASILY STORED CARRYING CASE

(76) Inventor: John Mellott, 5333 Industrial Dr., Huntington Beach, CA (US) 92649

( * ) Notice: Subject to any disclaimer, the term of this patent is extended or adjusted under 35 U.S.C. 154(b) by 0 days.

(21) Appl. No.: 10/909,526

(22) Filed: Aug. 3, 2004

(65) Prior Publication Data

US 2006/0030467 A1 Feb. 9, 2006

(51) Int. Cl.
*B31B 1/26* (2006.01)

(52) U.S. Cl. ..... 493/51; 493/52; 493/56; 493/68; 493/160; 493/906

(58) Field of Classification Search ..... 493/52, 493/56, 59, 68, 69, 89, 160, 162, 906; 220/6, 220/678, 642, 610; 229/199, 198.1, 198.2, 229/11.3

See application file for complete search history.

(56) References Cited

U.S. PATENT DOCUMENTS

| | | | | | |
|---|---|---|---|---|---|
| 2,578,644 | A | * | 12/1951 | Mautner | 217/65 |
| 2,590,159 | A | * | 3/1952 | Davis | 217/65 |
| 2,655,882 | A | * | 10/1953 | Tripp | 109/79 |
| 2,980,285 | A | * | 4/1961 | Parsons | 220/668 |
| 3,517,849 | A | * | 6/1970 | Presnick | 220/4.28 |
| 3,561,633 | A | * | 2/1971 | Morrison et al. | 220/1.5 |
| 3,989,157 | A | * | 11/1976 | Veenema | 220/4.28 |
| 4,744,445 | A | | 5/1988 | Anderson et al. | |
| 5,119,353 | A | * | 6/1992 | Asakura | 369/13.01 |
| 5,337,916 | A | * | 8/1994 | Voss | 229/182 |

* cited by examiner

*Primary Examiner*—Stephen F. Gerrity
*Assistant Examiner*—Hemant M. Desai
(74) *Attorney, Agent, or Firm*—David Bracken

(57) ABSTRACT

The present invention is a method and means for making a carrying case from two open topped boxes from sandwich wall construction, where one box will be lid and the other a base. Living hinges connect a floor section to four sidewalls ensuring accurate vertical alignment of the sidewalls with each other and with the floor section.

8 Claims, 6 Drawing Sheets

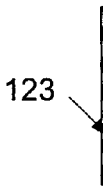
FIGURE 4
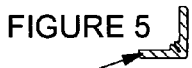
FIGURE 5
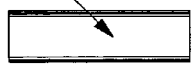
FIGURE 6
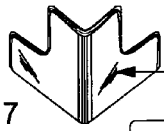
FIGURE 7
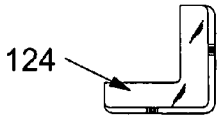
FIGURE 8
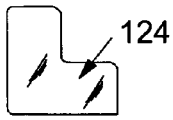
FIGURE 9
FIGURE 10
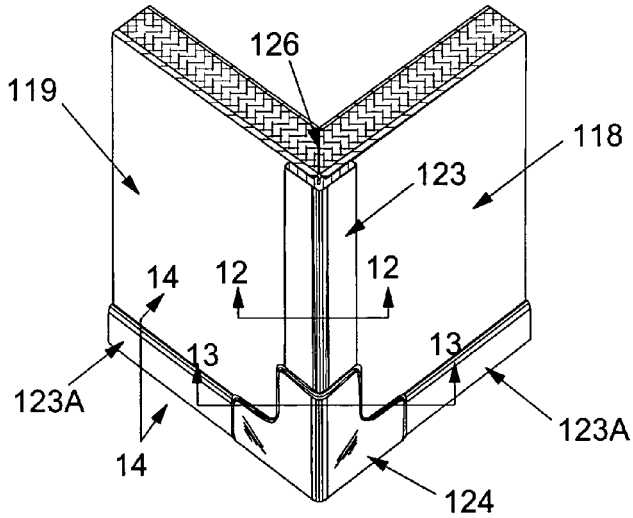
FIGURE 11
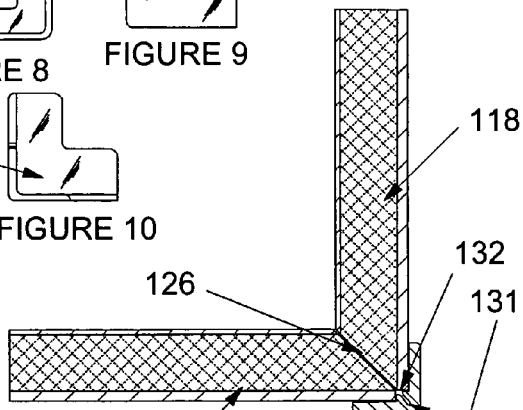
FIGURE 12
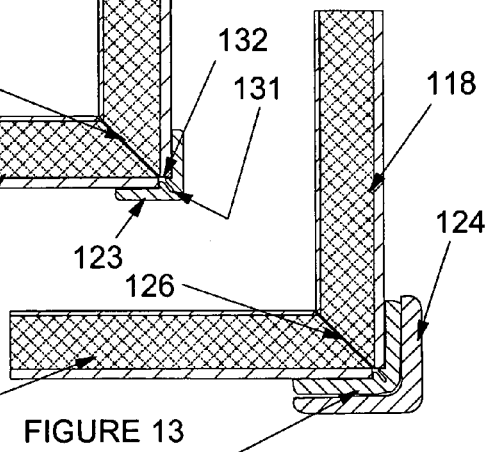
FIGURE 13
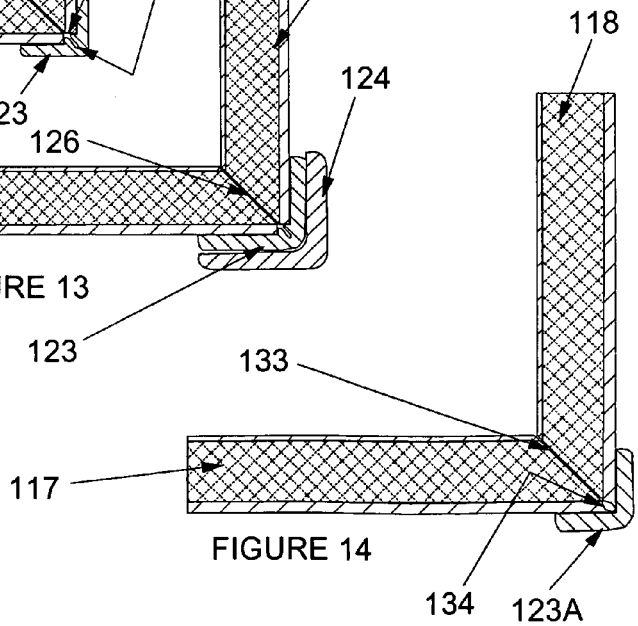
FIGURE 14

SANDWICH WALL CONSTRUCTION FOR A KIT BOX OR EASILY STORED CARRYING CASE

BACKGROUND OF THE INVENTION

The present invention relates to boxes with layered or sandwich wall construction, especially those which must withstand severe torsion forces.

The layered walls in construction of boxes is useful in that lighter and less expensive materials may be used as a fill material between two rigid sheets. It is well known to use polymer foam material such as styrofoam or other rigid foams between two rigid polymer sheets to form a sheet of exceptional lightness, insurability and strength. However, the desired features of such a sandwich wall or sheet are not easily obtained.

While an unassociated sandwich sheet is very strong, excessive flexing, shock or vibration causes the rigid sheets to delaminate from their bonded connection to the Styrofoam. This delamination essentially destroys a major part of the wall strength. Subsequent blows or strikes against a delaminated sheet causes the force of the blow or strike to be focused on a small area instead of being distributed over the entire sheet. The rigid polymer foam is then compressed or broken into fragments, causing delamination of the polymer sheet on the other side of the sandwich wall. When such sandwich walls are used in box construction, bonded connections between individual wall pieces becomes difficult to achieve while ensuring precise orientation of all the other pieces in the box. Failure to obtain such precise orientation results in a box that will fail.

U.S. Pat. No. 4,744,445 describes components and methods for assembling storage cases. Storage cases are made for a wide variety of applications including transportation, shipping and storage and are required in a wide variety of shapes and sizes. The '445 patent describes a kit for assembling a case having a base and a lid from a series of separate parts is provided, the kit allowing cases of any chosen dimensions to be made. The assembly kit was described as a series of panels of any chosen dimensions for forming the bottom, side and end walls of an open topped box-like enclosure base, and similar panels for forming a lid for closing the open top of the base, a series of angled corner strips for connecting adjacent edges of the panels together along the longitudinal and side edges of the base and lid to form the box-like enclosures, a hinge mechanism for hinging the lid to the base, and a latch mechanism for releasably closing the lid. The kit also included mateable or cooperable edge strips for securing around the open upper end of the base and lower edge of the lid, respectively, for mating engagement with one another when the lid is closed to restrict movement of the lid relative to the base. Also provided in the kit were corner pieces for securing at the lower four corners of the base and the upper four corners of the lid. Metable corner pieces were provided in the kit which are of similar configuration to the mateable edge strips for securing to the upper and lower corner edges, respectively, of the base and lid. The disclosure U.S. Pat. No. 4,744,445 is incorporated herein.

Although useful for careful hobbyists, the kit of the '445 patent was the subject of many product returns. A single mis-aligned connection among the several bonded (i.e., via glue, thermal welding or other such polymer bonding methods) connections that were needed to make the case would result in a useless collection of pieces. So many returns were experienced that actual construction of the cases according to the '445 patent was performed by Melmat, Inc. in Huntington Beach, Calif., a company experienced in manufacturing and assembly of plastic devices. Although the cases described in the '445 patent can with care be assembled by professionals, it would be desirable to reduce the manufacturing care requirements to reduce manufacturing time and cost.

The case according to the '445 patent is shown and described using wall material of a single layer. The thickness of the wall material is relatively thin. It has been found that the wall material of the case according to the '445 patent is relatively weak compared with boxes formed with sandwich walls. However, the '445 patent and the prior art fail to indicate how the case of the '445 patent could be change to accommodate sandwich wall construction. There is a need for a case having the reduced number of manufacturing components as that of the '445 patent while obtaining the benefits of sandwich wall construction.

SUMMARY OF THE INVENTION

The invention comprises methods and means for ensuring sandwich wall alignment in a kit box or easily assembled box. The component panels or walls of the box are cut from a large assembly sheet formed of a core of rigid polymer foam, such as styrofoam, and sandwiched between two layers of rigid polymer sheets, preferably ABS (acrylonitrile-butadiene-styrene). The assembly sheets are formed in relatively large sheets, such as four by eight feet, and stored until an order for an invention box is received by a vendor for the invention box. The assembly sheets have an overall uniform thickness of about one centimeter or more. An inner polymer sheet is preferably about one half the thickness of an outer polymer sheet.

In the invention method, two types of router cuts are made in the assembly sheet to form all the sandwich walls of the invention box or case. In this method, five sandwich walls of an open topped box are connected with living hinges to a floor section. After assembly as described below, two of such open topped boxes are connected by a hinge as described in the '445 patent to form an assembled case.

A first router cut defines a floor section. The floor section is rectangular and defined by four peripheral grooves in the outer polymer sheet. Extending inward from each peripheral groove is a 45 degree slope cut into the foam core and inner polymer sheet. The peripheral groove removes sufficient material from the outer polymer sheet to form a living hinge. Extending perpendicular to and outward from each peripheral groove is a sidewall section, four sidewall sections in all. Each sidewall section comprises two additional, second router cuts. These router cuts are similar to first router cuts except that the outer polymer sheet is cut through entirely. A distal edge of each sidewall section is cut at a 90 degree angle with respect to the surfaces of the assembly sheet.

The floor section and sidewall sections are continuously connected through the outer polymer sheet to form the sandwich walls section. Each sidewall section extends from its peripheral groove outward from the floor section to define a reduceable sidewall height. While each sidewall must have the same sidewall height, that height can be changed by the manufacturer or kit assembler. A manufacturer can make and store several sandwich walls sections. Alternately, a kit assembler can receive an unmodified sandwich walls section. The manufacturer or kit assembler can easily make cuts off the free ends of each sidewall section, where those cuts are parallel with the peripheral groove. The ability to make these cuts gives the manufacturer or kit assembler a quick way to form an open ended box with precisely the height desired for a particular need.

The peripheral grooves are hinges whereby the sidewalls can be rotated upward 90 degrees until they precisely and easily abut adjacent sidewall sections and the floor section at 45 degree sloped edges. An assembler impresses corner setting means to each of four top corners formed by raising the sidewalls.

Corner setting means preferably comprise an edge piece in combination with a corner section of a closure edge. The edge piece is adapted to precisely align edges of adjacent outer polymer sheets of adjacent sidewalls. However, the edge piece must be urged properly into a space between those edges of adjacent outer polymer sheets of adjacent sidewalls. Impressing the corner section of a closure edge onto the edge piece effectively performs that task.

When the bonding agent sets joining the abutting surfaces of the sloped edges, an assembler then adhesively applies edge pieces to all box edges excepting a top edge. To bottom corners, an assembler adhesively applies bottom corner pieces. To the top edges, the assembler bonds four corner sections of the closure edge respectively to the four top corners of the box. In a last step to form an open top box that will form one half of the invention case, the assembler adhesively connects to four free or open top edges a set of four top edge pieces of the closure edge.

Two open top boxes formed according to the above method with mateable closure edges are connected by hinges and a releasable latch to form an invention case.

In an alternate embodiment, only two sidewalls sections extend respectively from two grooves at opposite edges of the floor section. Two separate sidewalls are formed separate from the sandwich walls section to fit into the two vacant sidewalls areas. The benefit of obtaining precise orientation is somewhat reduced with this embodiment, although some of the objects of the invention are obtained thereby.

Preferably, all the parts or components of the kit are of plastics material and are secured to one another by bonding. The panels, angled corner strips and edge strips may be provided in standard sizes and lengths for cutting to size by the purchaser, or may be provided in pre-cut dimensions for assembling of predetermined size cases by the purchaser. With this kit cases can be quickly, inexpensively and easily assembled in an unlimited range of sizes, simply by appropriate choice of the dimensions of the panels, corner and edge strips before bonding the various parts together. The lid and base are preferably of similar box-like format, and may be of the same or different depths as desired. According to another aspect of the invention a method of assembling a case of any chosen length, width and height from a kit of parts is provided, which comprises the steps of:

- cutting a series of connected (via hinges) panels to predetermined dimensions to form the bottom, side and end walls of a box-like base and top, side and end walls of a box-like lid for the case;
- bond corner angle strips along the adjacent edges of the side and end walls of the base and lid, respectively, to form a box-like rectangular enclosure, and along the adjacent edges of the bottom wall and adjacent lower edges of the side and end walls, and the edges of the upper wall and adjacent upper edges of the side and end walls of the lid, respectively to form right angle joints between the respective panels and provide two separate box-like enclosures;
- bond closure strips having a first mateable formation along at least part of the open edge of one of the formed enclosures and bond closure strips having a second formation mateable with the first along at least part of the open edge of the other formed enclosure;
- bond a two part hinge mechanism to the base and lid enclosure, respectively, to form a hinge connection between the lid and base (although hinges and hasps may be mechanically fastened by bolts or screws); and
- bond a first part of a latch mechanism to the lid and a second part of a latch mechanism to the base, the two parts being releasably connectable together to releasably secure the lid to the base in its closed position.

The kit assembly may also include a carrying handle which may be bonded or otherwise secured to the assembled case, feet members or pads for securing to the bottom of the case, and one or more cover stops for securing to the inside of the case to hold the lid or cover partially or completely open. The hinge mechanism may comprise one or more hinges each formed from two separable hinge parts which are preferably only separable in one particular orientation of the two hinge parts to prevent the lid from becoming accidentally separated from the base.

BRIEF DESCRIPTION OF THE DRAWINGS

FIGS. 4, 5 and 6 are respectively top, end and side view of an edge piece.

FIGS. 7, 8, 9 and 10 are respectively front upper perspective, end, side and top views of a corner piece.

FIG. 11 is an upper perspective view of a broken away part of two sidewalls and a floor piece joined with edge pieces and a bottom corner piece.

FIG. 12 is a sectional view along line 12—12 of FIG. 11.

FIG. 13 is a sectional view along line 13—13 of FIG. 11.

FIG. 14 is a sectional view along line 14—14 of FIG. 11.

DETAILED DESCRIPTION OF THE INVENTION

The invention is now discussed with reference to the figures.

Figure 1:
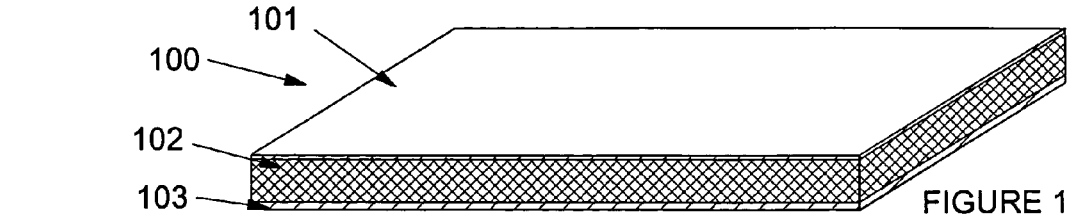
FIG. 1 is a perspective view of an assembly sheet.
Figure 2:
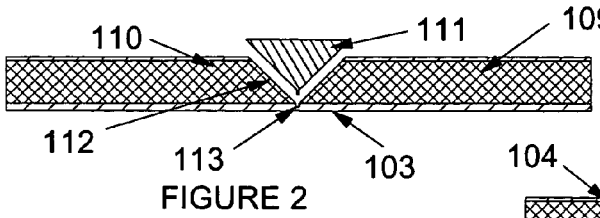
FIG. 2 is a side view of an assembly sheet after having a first router cut.
Figure 2A:
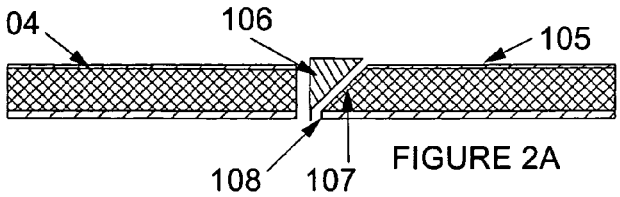
FIG. 2A is a side view of an assembly sheet after having a second router cut.

FIG. 1 shows assembly sheet 100 comprising inner polymer sheet 101 and outer polymer sheet 103 encasing core 102. Inner polymer sheet 101 is preferably formed from a rigid polymer with a thickness of about from about 0.8 to 2.0 millimeters. Outer polymer sheet 103 is preferably formed from a rigid polymer with a thickness of about from about 1.5 to 4.0 millimeters, where sheet 101 is about one half the thickness of sheet 103. Core 102 consists of a rigid polymer foam, such as styrofoam, having an overall thickness of about from one half centimeter to three centimeters. As FIG. 2 shows first router cut outline 111 having made a first router cut in the assembly sheet so that V-cut 112 is made separating inner polymer sheet and core sections to form portions 109 and 110 and forming groove 113 in outer polymer sheet 103. FIG. 2A shows second router cut outline 106 having made a second router cut in the assembly sheet so that V-cut 107 is made separating inner polymer sheet, core and outer polymer sheet sections to form portions 104 and 105 and forming 90 degree cut 108 in the outer polymer sheet. These first and second router cuts are critical to achieving the objects of the invention.

Figure 3:
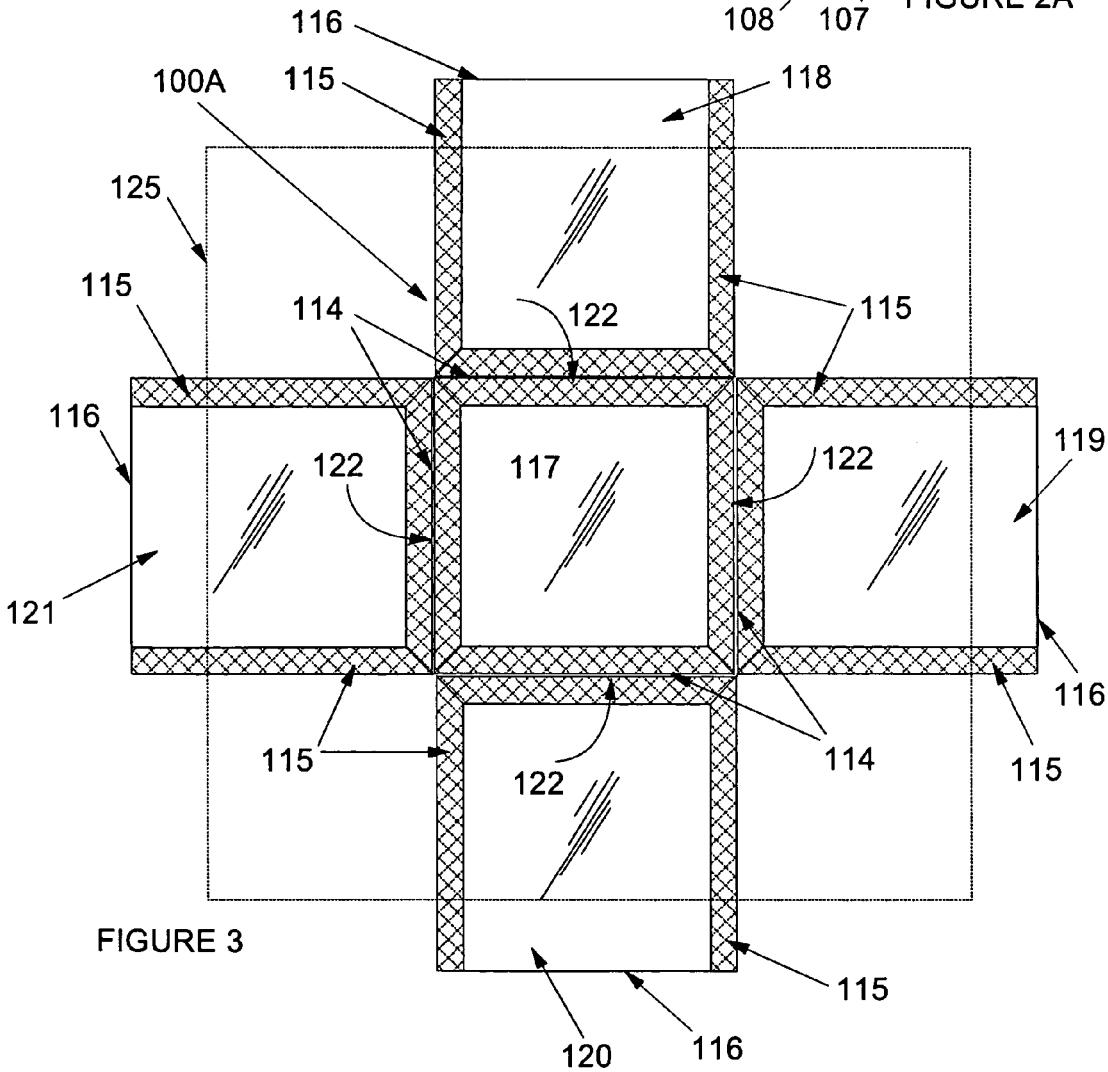
FIG. 3 is a top view of an assembly sheet made into a sandwich walls section after having first and second router cuts made according to the invention method.

FIG. 3 shows an assembly sheet after receiving desired first and second router cuts to form a flat sandwich walls section 10A. First router cuts 114 define floor section 117 attached by living hinges 113 (as in FIG. 2) to sidewalls 118 through 121 so that sidewalls 118 through 121 can rotate along paths 122. Sidewalls 118 through 121 receive lateral second router cuts 115 to form surfaces that will abut when the sidewalls are rotated up along paths 122 so that the sidewalls are substantially perpendicular to floor section 117. Distal edges 116 of the sidewalls are cut to form a 90 degree angle with the polymer sheets that sandwich the foam core.

Each of the sidewalls of FIG. 3 have a box height defined by the distance from the peripheral groove in cuts 114 to edges 116. This box height is predetermined in one embodiment so that it is equal to or greater than the tallest box typically required for a floor section 117 size. For instance, if the inner polymer sheet of floor section 117 is a twelve inch square, customers might typically not want a box height greater than twenty four inches, although many customers have ordered boxes with heights from six inches to twenty inches in height. The box height of the sidewalls in this example would be twenty four inches at the initial manufacturing step. Many such sandwich walls sections 100A may be profitably manufactured at a single substantially continuous operation instead of making them one at a time. If a box with a box height less than twenty four inches is ordered, i.e., say sixteen inches, cuts 125 can be quickly made and the box assembled with the desired height. With sandwich walls section 100A manufactured with a maximum box height, a customer may purchase such a section 100A as a part of a kit to assemble the invention case and easily reduce the box height after purchase to obtain a desired box height.

FIGS. 4 through 6 and 12 show edge piece 123 used on all vertical edges of an assembled box. FIG. 14 shows edge piece 123A used on bottom edges of the assembled box. The interaction of edge piece 123 and 123A with the assembled box edges is critical to the invention. FIG. 12 shows that groove 131 is formed in the interior length of edge piece 123, groove 131 being capped with longitudinal ridges 132 on either side of groove 131. FIG. 12 shows that ridges 132 and groove 131 cooperate to separate the square edges of the outer polymer sheets of sidewalls 118 and 119 with a tolerance permitted by compression of ridges 132 into groove 131. Surprisingly, the equivalent function has been found to be duplicated in the combination of the folded peripheral groove 134 and edge 123A of FIG. 14, where groove 134 permits the same slight edge to edge compression of the outer polymer sheets as groove 131 of edge piece 123 in FIG. 12. With sandwich wall construction in the invention box, precise alignment of the outer polymer sheets in the assembled box is critical to obtaining required box strength. As described below, use of the living hinges of the peripheral groove and use of corner alignment means are necessary steps for relatively untrained persons to obtain an effectively applied edge section 123 in the assembled box according to the invention.

FIGS. 7 through 10 show the bottom corner piece 124 that is adapted to be bonded to the outer surfaces of edge pieces 123 and 123A at bottom corners of the box shown in FIG. 11. Bonded connections are made at:

(a) interface 126 shown in FIGS. 11, 12 and 13 between the adjacent surfaces of the second router cuts on sidewalls 118 and 119;

(b) interface 133 shown in FIG. 14 between adjacent surfaces on floor section 117 and sidewall 118;

(c) the contact interface between edge 123 and sidewalls 118 and 119 as in FIG. 12;

(d) the contact interface between corner piece and edge pieces 123 and 123A as in FIGS. 11 and 13; and (e) the contact interface between edge 123A and floor section 117 and sidewall 118 as in FIG. 14.

Figure 15:
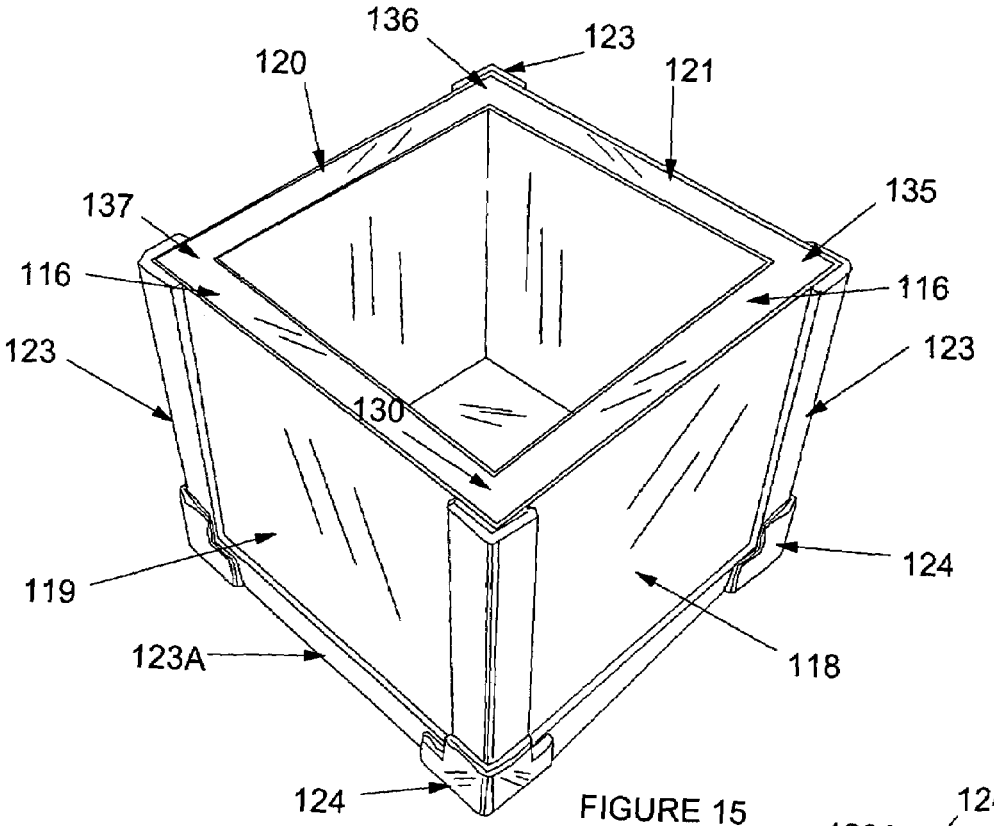
FIGS. 15 and 16 are respectively top perspective and bottom views of the sandwich walls section of FIG. 3 assembled with edge pieces and bottom corner pieces.
Figure 16:
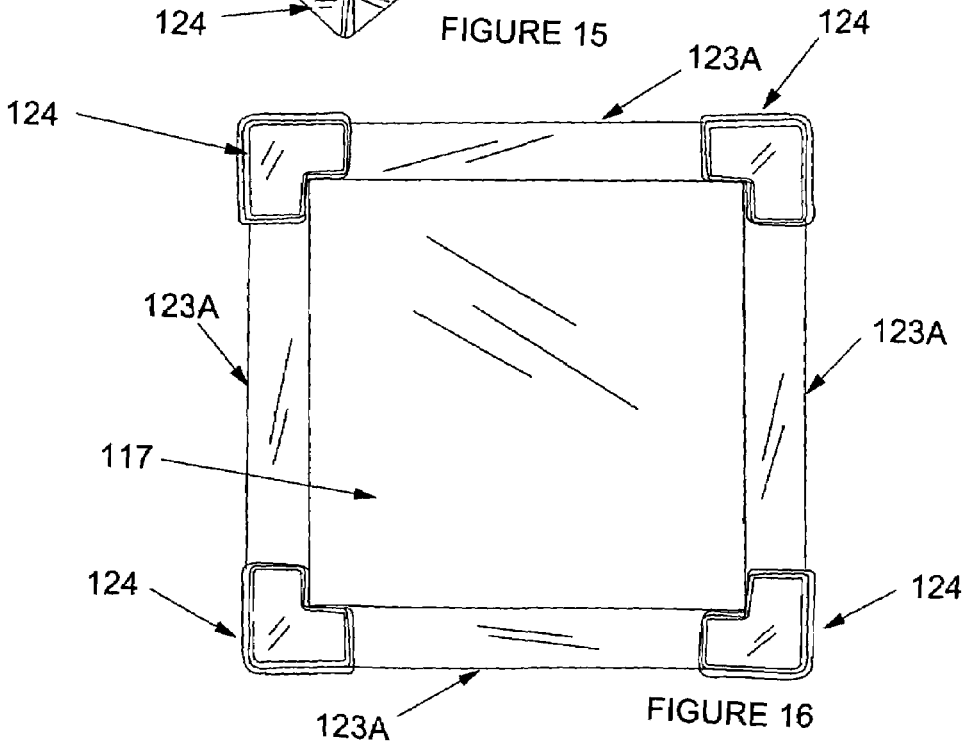

FIG. 15 shows an assembled box without closure edges. Interfaces 135, 136 and 137 are bonded interfaces as for interface 126. FIG. 16 shows a bottom view of the assembled box of FIG. 15.

Figure 17:
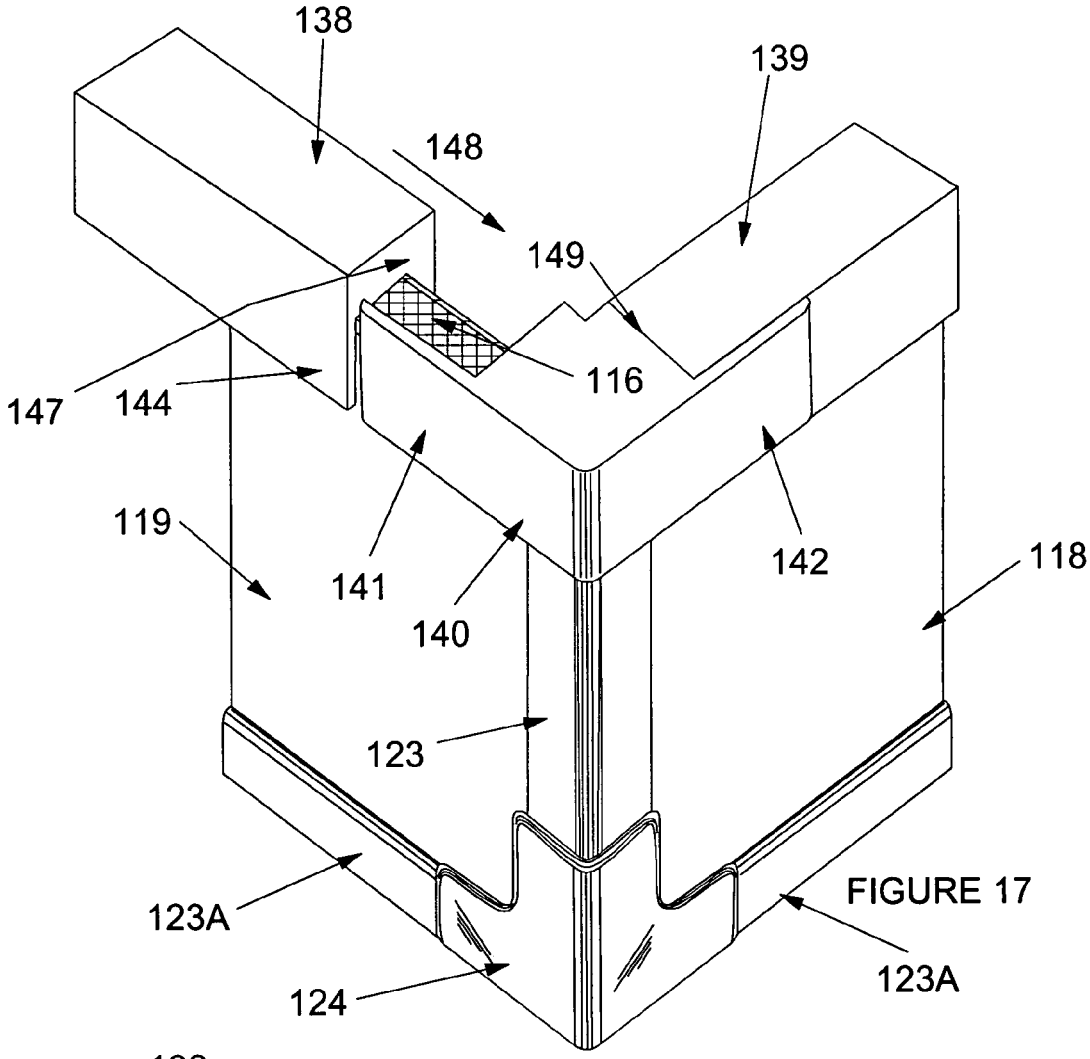
FIG. 17 is a broken away view of part of two sidewalls and a floor piece joined with edge pieces and a bottom corner piece and urged into alignment with a top corner piece.
Figure 18:
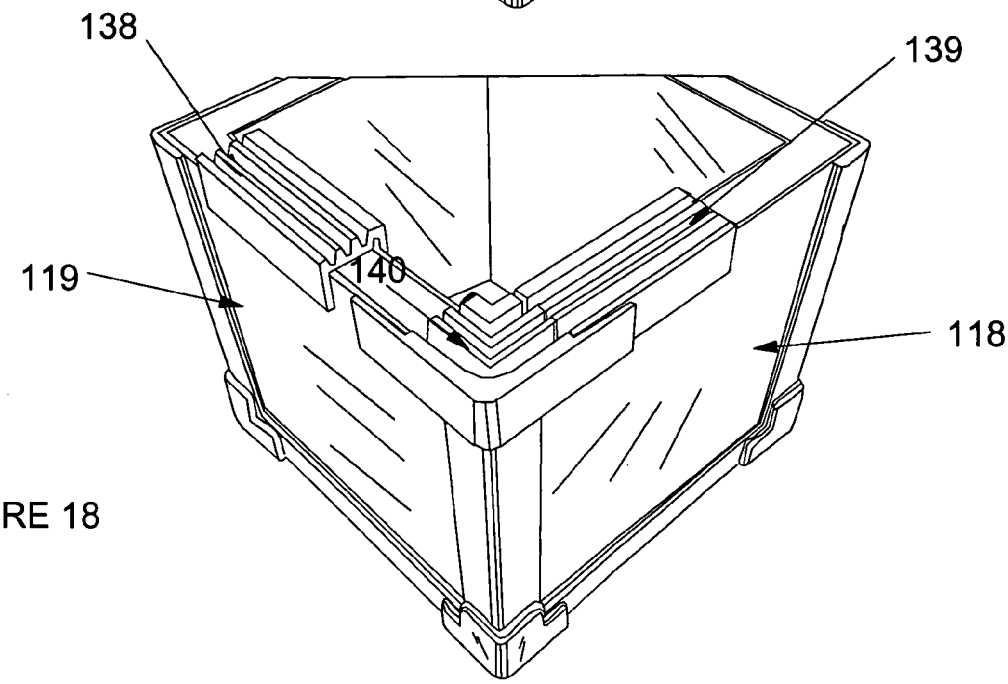
FIG. 18 shows additional detail of the closure edges of FIG. 17.
Figure 19:
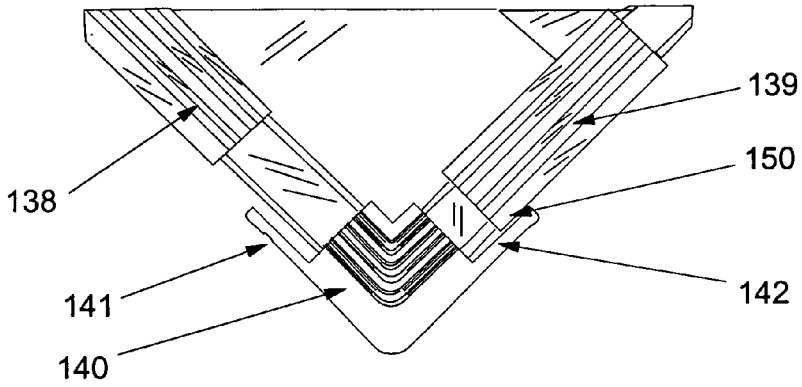
FIG. 19 is a top view showing closure edges on a top edge of the box of FIG. 11

FIGS. 17 and 18 show closure edges 138 and 139 and top corner piece 140 adapted to engage edges 116 of the sidewalls. Corner piece 140 is further adapted to impress the ridges 132 of edge 123 into the space between the adjacent edges of outer polymer sheets (as in FIG. 12) at the step of gluing interfaces 126, 135, 136 and 137 together to precisely align the sidewalls of the assembled box. FIG. 17 shows that corner piece 140 comprises two flanges 141 and 142 spaced apart from the outer polymer sheet so that wall section 144 of closure edge 138 may be moved into that space by moving closure edge 138 in direction 148 so its end 147 abuts corner piece 140 to form an interface similar to that of interface 149 for closure edge 139.

Figure 20:
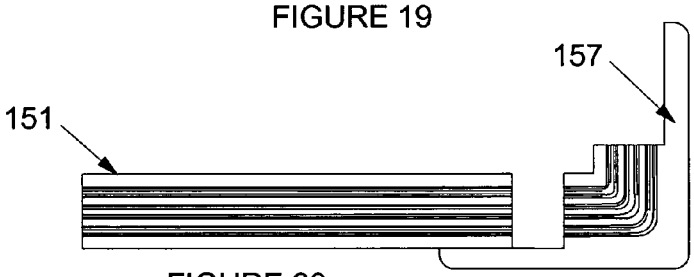
FIG. 20 is a top view of a top edge piece and a top corner piece adapted to receive an O-ring.
Figure 21:
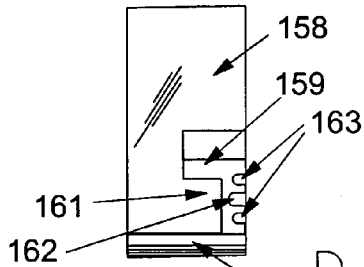
FIGS. 21 and 23 show respectively end and underside views of the top corner piece of FIG. 19.
Figure 22:
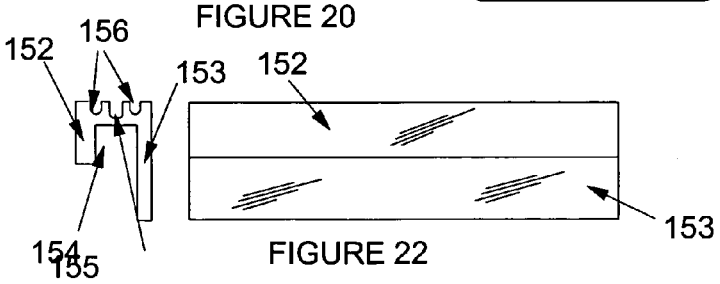
FIG. 22 show inner side and end views of the top edge piece of FIG. 19.
Figure 23:
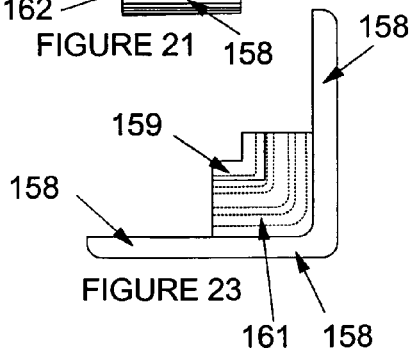

FIGS. 20 and 22 show a gasket closure edge 151 comprising an outer wall 153 joined to an inner wall 152 by top section defining gasket groove 155 and alignment grooves 156. The walls 152 and 153 and the top section define a longitudinal cavity 154 adapted to engage edge 116. FIGS. 20, 21 and 22 show a gasket corner piece comprising an outer wall 158 joined to an inner wall 159 by top section defining gasket groove 162 and alignment grooves 163. An inside surface of wall 159 is adapted to engage a top part of the inner polymer sheets of the sidewalls at their top corners after bringing them into bonded connection as described above. An inside surface at the corner portion of wall 158 is adapted to urge an outer surface of edge 123 inward so that its ridges 132 precisely space apart edges of the outer polymer sheets. At the same time, the corner piece compresses adjacent sidewalls together to form a secure, bonded interface. The top corner piece acts to properly horizontally align the outer polymer sheets while the living hinge connecting the sidewalls to the floor section have provided proper vertical alignment.

Figure 24:
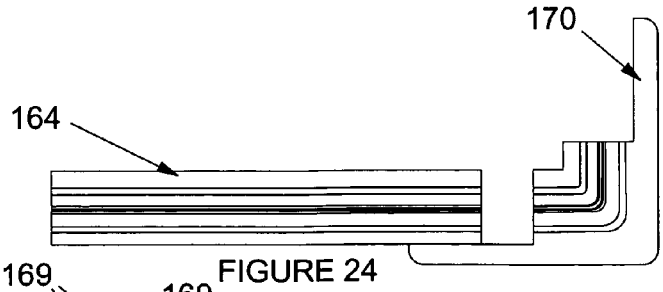
FIG. 24 is a top view of a top edge piece and a top corner piece adapted to mateably engage respectively the top edge piece and top corner piece of FIG. 19.
Figure 25:
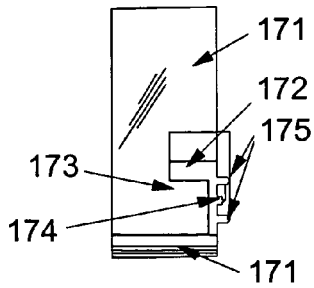
FIG. 25 is an end view of the top corner piece of FIG. 24.
Figure 26:
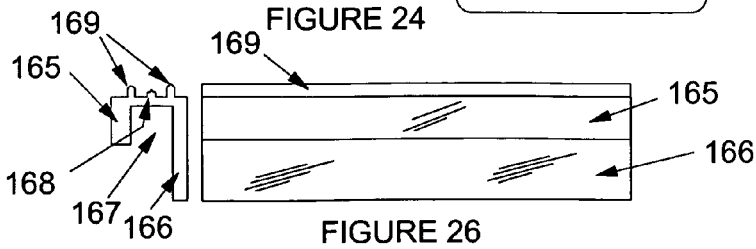
FIG. 26 show inner side and end views of the top edge piece of FIG. 24.

FIGS. 24 and 26 show a gasket closure edge 164 comprising an outer wall 166 joined to an inner wall 165 by top section defining gasket ridge 168 and alignment ridges 169. The walls 165 and 166 and the top section define a longitudinal cavity 167 adapted to engage edge 116. FIGS. 25 and 26 show a sealing corner piece comprising an outer wall 171 joined to an angled inner wall 172 by a top section defining gasket ridge 174 and alignment ridges 175. An inside surface of wall 172 is adapted to engage a top part of the inner polymer sheets of the sidewalls at their top corners after bringing them into bonded connection as described above. An inside surface at the corner portion of wall 171 is adapted to urge an outer surface of edge 123 inward so that its ridges 132 precisely space apart edges of the outer polymer sheets. At the same time, the corner piece compresses adjacent sidewalls together to form a secure, bonded interface. The top corner piece acts to properly horizontally align the outer polymer sheets while the living hinge connecting the sidewalls to the floor section have provided proper vertical alignment.

Figure 27:
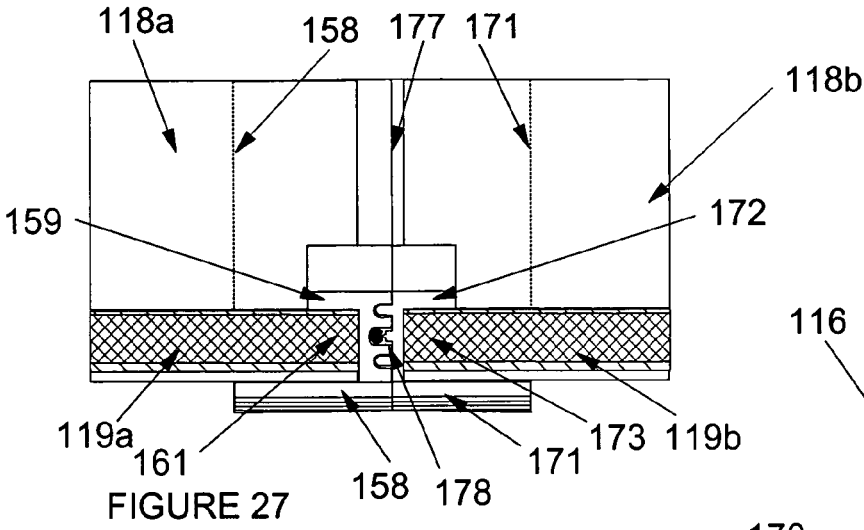
FIG. 27 is a broken away end view of the top corner pieces of FIGS. 21 and 25 and engaged sidewalls, with the top corner pieces mateably engaged as they would be when the invention case comprises two box sections connected by hinges and latched into a closed position.

FIG. 27 shows corner pieces 157 and 170 engaged respectively to sidewalls 118*a*/119*a* and sidewalls 118*b*/119*b* and brought together as they would be mateably engaged in a case comprising two boxes constructed as described above and connected by hinges and a latch. Interfaces 177 and 178 show that properly constructed boxes of the invention precisely mate along mateable closure edges and corner pieces with ridges 175 and 169 continuously respectively engaging grooves 163 and 156. It is most preferred that ridges 175 and 169 continuously respectively engaging grooves 163 and 156 permit a lateral tolerance of 0.2 to 1.0 millimeter so that the ridges 175 and 169 are slightly movable laterally when engaged in a closed position. Accumulation of acceptable tolerance errors in routing and assembly of the top and bottom halves of the invention box are surprisingly easily resolved by such tolerance for dust-tight and spray-tight closure of the halves of the invention box.

Figure 28:
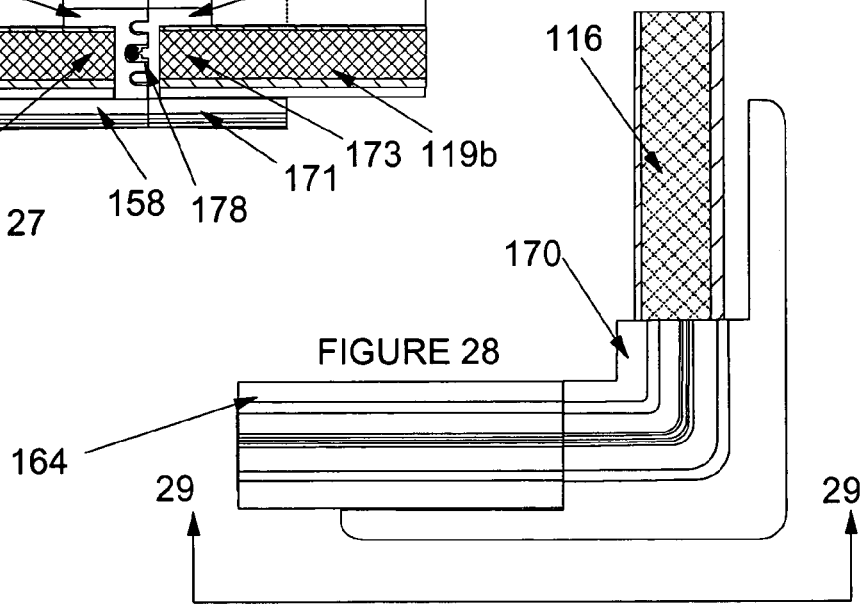
FIG. 28 is a top view of a top edge piece and top corner piece as in FIG. 24 shown mounted on the sidewalls of FIG. 17.
Figure 29:
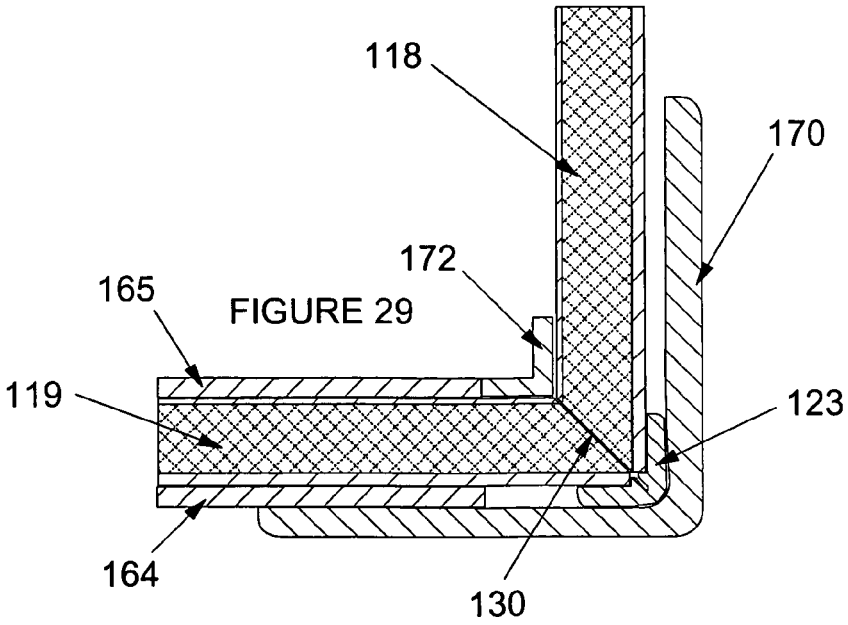
FIG. 29 is a sectional view along line 29—29 of FIG. 28.

FIGS. 28 and 29 show assembly details of closure edge 164 and corner piece 170 mounted on edges 116 of engaged sidewalls.

The above design options will sometimes present the skilled designer with considerable and wide ranges from which to choose appropriate apparatus and method modifications for the above examples. However, the objects of the present invention will still be obtained by that skilled designer applying such design options in an appropriate manner.

I claim:

1. A method for making two open top boxes as a base and lid of a carrying case, the base and lid being hinged together along rear edges and having a releasable latch mechanism for releasably securing the lid to the base at the front edge in a closed position comprising:

(a) for each of the open topped boxes, an assembly sheet having a flat core sheet of rigid polymer foam with a uniform thickness of between one to three centimeters, the core sheet bonded on an inside surface to an inner polymer sheet and bonded on an outside surface to an outer polymer sheet, where the outer polymer sheet comprises rigid polymer with a thickness greater than or equal to 1.5 millimeters and the inner polymer sheet comprises rigid polymer with a thickness about one half that of the outer polymer sheet;

(b) making four first router cuts in the assembly sheet, where on each side of the first router cuts the inner polymer sheet and core sheet are cut through to form a 45 degree surface sloping toward a center line from the inner polymer sheet and downward across the core sheet, where an inner surface of the outer polymer sheet is also partly cut through to define a rectangular peripheral groove with four corners along said center line, the rectangle of the peripheral groove establishing edges of a floor section and forming a living hinge with the adjacent outer polymer sheet;

(c) making eight second router cuts, two from each corner of the peripheral groove so that each second router cut:

(i) is normal to a side of the rectangular peripheral groove;

(ii) extends outward from the floor section equal in length to a first box height; and (iii) on an edge of a sidewall extending normal to an edge of the peripheral groove, forms a 45 degree surface sloping from the inner polymer sheet down across the core sheet to its outer surface, where a 90 degree surface on an edge of the outer polymer sheet is formed relative to the plane of the outer polymer sheet;

(d) making four end cuts through the assembly sheet to define four sidewalls, each end cut extending from ends of the second router cuts and parallel to a different edge of the peripheral groove, where the end cuts form 90 degree surfaces relative to the plane of the outer polymer sheet;

(e) applying sloped wall adhesive to the sloped surfaces of the floor section and the sidewalls;

(f) rotating the sidewalls upward substantially 90 degrees about the living hinges connecting the sidewalls with the floor section so that all the sloped surfaces contact an adjacent sloped surface and the surfaces of the end cuts substantially form a plane to form an open topped box with four top corners;

(g) prior to the sloped wall adhesive setting, applying an edge piece to an outside surface of each top corner and closure edges to top edges, wherein each said edge piece comprises longitudinal ridges adapted to provide a required spacing relationship to adjacent 90 degree edges of the outer polymer sheets of the sidewalls; and (h) applying four top corner pieces and four bottom corner pieces to respective each of the top and bottom corner; wherein each said top corner piece abuts an inner surface of the top corners, spans a top edge of the top corner, and extends downward to urge a top end of each said edge piece onto an outer edge of the box and thereby urging said longitudinal ridges into a required spacing relationship to adjacent 90 degree edges of the outer polymer sheets of the sidewalls; and wherein each said bottom corner piece is bonded to an outside surface of the edge pieces at each said bottom corner of the box.

2. The method of claim 1 wherein the top corner pieces and the closure edges joining them along the top edges of one box are mateable with the top corner pieces and the closure edges joining them along the top edges of the other for mating engagement when one box as said lid is closed on another box as the base.

3. The method of claim 1 wherein the floor section is square.

4. The method of claim 1 wherein the floor section has a length longer than a width of the rectangular peripheral groove.

5. The method of claim 1 wherein the assembly sheet after performing steps (a) through (d) is stored with a plurality of others of substantially identical sizes.

6. The method of claim 5 wherein a kit is formed comprising one of said assembly sheet, edge pieces, bottom edge pieces, bottom corner pieces, closure edges, top corner pieces, hinges and a latch.

7. The method of claim 6 wherein a purchaser purchases the kit and makes four new end cuts reducing the first box height to a second box height.

8. The method of claim 5 wherein an owner of said assembly sheet receives an order for a case with a second box height less than the first box height and makes four new end cuts reducing the first box height to a second box height.

* * * * *